United States Patent [19]

Asano et al.

[11] Patent Number: 4,554,176

[45] **Date of Patent: * Nov. 19, 1985**

[54] DURABLE ELECTRODE FOR ELECTROLYSIS AND PROCESS FOR PRODUCTION THEREOF

[75] Inventors: Hiroshi Asano, Chiba; Takayuki Shimamune, Tokyo; Kazuhiro Hirao; Ryuta Hirayama, both of Kanagawa, all of Japan

[73] Assignee: Permelec Electrode Ltd., Kanagawa, Japan

[ * ] Notice: The portion of the term of this patent subsequent to Nov. 27, 2001 has been disclaimed.

[21] Appl. No.: 602,861

[22] Filed: Apr. 23, 1984

Related U.S. Application Data

[62] Division of Ser. No. 575,602, Jan. 31, 1984, Pat. No. 4,481,097.

[30] Foreign Application Priority Data

Jan. 31, 1983 [JP] Japan ..... 58-12919

[51] Int. Cl.[4] ..... C25B 11/10

[52] U.S. Cl. ..... 427/125; 427/126.3; 427/126.5; 427/226; 427/405; 427/419.2; 427/419.3

[58] Field of Search ..... 204/290 R, 290 F, 291; 427/123, 125, 126.3, 126.5, 226, 405, 419.2, 419.3

[56] References Cited

U.S. PATENT DOCUMENTS 3,950,240 4/1976 Cookfair et al. ..... 204/290 F
4,212,725 7/1980 Habermann et al. ..... 204/290 F

FOREIGN PATENT DOCUMENTS 1206863 9/1970 United Kingdom ..... 204/290 F

*Primary Examiner*—Richard Bueker
*Attorney, Agent, or Firm*—Sughrue, Mion, Zinn, Macpeak and Seas

[57] ABSTRACT

An electrode comprising a substrate of a conducting metal, a coat of an electrode active substrate, and a layer interposed between the substrate and the coat to serve as a protective barrier for the substrate acquires improved durability by using, as the intermediate layer, a layer having platinum dispersed in a mixed oxide consisting of an oxide of at least one metal selected from the group consisting of titanium and tin, each having a valence of 4, and an oxide of at least one metal selected from the group consisting of tantalum and niobium, each having a valence of 5. The electrode of improved durability is produced by a process which comprises the steps of preparing a substrate of a conducting metal, depositing a solution containing salts of Ti and/or Sn, Ta and/or Nb, and Pt on the substrate, heating the resultant coated substrate under the blanket of an oxidizing gas thereby forming an intermediate layer on the substrate, and subsequently coating the intermediate layer with a layer of an electrode active substance.

10 Claims, No Drawings

DURABLE ELECTRODE FOR ELECTROLYSIS AND PROCESS FOR PRODUCTION THEREOF

This is a division of application Ser. No. 575,602, filed Jan. 31, 1984, U.S. Pat. No. 4,481,097 11-6-84.

FIELD OF THE INVENTION

This invention relates to an electrode for use in electrolysis, and more particularly to an electrolytic electrode which exhibits outstanding durability in the electrolysis of an aqueous solution such as is liable to entail generation of oxygen at the anode.

BACKGROUND OF THE INVENTION

Heretofore, electrolytic electrodes using substrates of valve metals such as titanium (Ti) have found recognition as outstanding insoluble metal electrodes and have found utility as such in various fields of electochemistry. Particularly in the industry specializing in electrolysis of common salt, these electrodes have been found extremely useful as anodes for the generation of chlorine. As valve metals, tantalum (Ta), niobium (Nb), zirconium (Zr), hafnium (Hf), vanadium (V), molybdenum (Mo), tungsten (W), etc. have been known to the art besides Ti mentioned above.

These metal electrodes are generally obtained by coating substrates of the metal Ti with various electrochemically active substances represented by platinum-group metals or oxides thereof. Such electrodes disclosed by U.S. Pat. Nos. 3,632,498 and 3,711,385 are familiar examples. These electrodes, particularly when used for the generation of chlorine, are capable of retaining a low chlorine overvoltage for a long time.

When such a metal electrode as described above is adopted as an anode in electrolysis intended for or entailing generation of oxygen, the overvoltage of the anode is gradually raised. In an extreme case, this rise of overvoltage may induce a severe problem in that the anode will be passivated and prevented from continuing electrolysis any further. This phenomenon of the passivation of the electrode is believed to be best explained by a postulate that the Ti substrate is oxidized by the oxygen issuing from the oxide coat itself of the electrode or by the reaction of the substrate with the oxygen or the electrolyte permeating the coat and reaching the substrate. Consequently, a non-conducting Ti oxide coating forms on the substrate. Also, since the non-conducting oxide is formed in the interface between the substrate and the coat of the electrode, a further disadvantage may arise in that the oxide interface possibly could cause the electrode coat to separate from the substrate and eventually render the electrode completely unserviceable.

Electrolytic processes in which the anode product is oxygen, or in which oxygen is generated at the anode as a side reaction, include: (1) electrolysis using a sulfuric acid bath, a nitric acid bath, alkali baths, or the like; (2) electrolytic separation of Cr, Cu, Zn, or the like; (3) various forms of electroplating; (4) electrolysis of dilute brackish water, brine water, hydrochloric acid, or the like; and (5) electrolysis for the production of chlorates, and so forth.

To date, however, the problem mentioned above has been a serious obstacle to the effective use of metal electrodes in these industrial fields.

As a solution to this problem, a technique of preventing the electrode from being passivated due to the permeation of oxygen is described in U.S. Pat. No. 3,775,284. This technique involves interposing between the conducting substrate and the coat of the electrode a barrier layer formed of a Pt-Ir alloy or an oxide of cobalt (Co), manganese (Mn), palladium (Pd), lead (Pb), or platinum (Pt). The substances which constitute the interposed barrier layer, to some extent, prevent oxygen from being dispersed into the substrate during electrolysis. Nevertheless, the substances of the barrier layer possess a fair degree of electrochemical activity and, therefore, react with the electrolyte permeating the coat of the electrode and produce electrolytic products, e.g., gas, on the surface of the interposed barrier layer. Thus, there ensues the possibility that the physical and chemical actions of the electrolytic product will impair the tight adhesion of the coat of the electrode to the substrate and cause separation of the coat of the electrode from the substrate before the service life of the substance constituting the coat of the electrode is exhausted. Additionally, the barrier layer itself causes problems in that it prevents the electrode from being sufficiently corrosionproof. Thus, the solution produces a new problem and fails to provide lasting protection for the electrode.

U.S. Pat. No. 3,773,555 discloses an electrode which is coated with a laminate composed of a layer of an oxide, such as of Ti, and a layer of a platinum-group metal or an oxide thereof. This electrode nevertheless has the disadvantage in that the electrode undergoes passivasion when used in electrolysis in which oxygen is liberated.

SUMMARY OF THE INVENTION

The present invention is intended to overcome the above-described problems.

Accordingly, an object of the present invention is to provide an electrolytic electrode resistant to passivation, amply durable, and, therefore, particularly suitable for use in the aforementioned various electrolytic processes involving liberation of oxygen.

Another object of the present invention is a process for the production of an electrode having the above-mentioned characteristics.

The above-described objects have been met by an electrolytic electrode having a conducting metal such as Ti as the substrate and an outer coating of an electrode active substance, characterized by having interposed between the substrate and the electrode coat an intermediate layer having Pt dispersed in a mixed oxide consisting of an oxide of at least one metal selected from the group consisting of Ti and Sn, both having a valence of 4, and an oxide of at least one metal selected from the group consisting of Ta and Nb, both having a valence of 5.

This invention also relates to a process for the production of the electrolytic electrode.

The aforementioned intermediate layer of this invention is highly corrosionproof and possesses extremely low electrochemical activity and fulfills a main function of protecting the electrode substrate, such as of Ti, and preventing the electrode from passivation. In conjunction with the main function, the intermediate layer fulfils an auxiliary function of conferring good conductivity upon the electrode and producing a powerful union between the substrate and the coat of the electrode.

In accordance with this invention, therefore, there is provided an electrode which can be used as an electrode with ample durability in an electrolytic process which is adopted for the generation of oxygen or which entails a secondary reaction liberating oxygen.

DETAILED DESCRIPTION OF THE INVENTION

The present invention will now be described in more detail.

The substrate of the electrode in the present invention may be made of a conducting corrosionproof metal such as Ti, Ta, Nb, or Zr or an alloy based on such a metal. The metal Ti and the Ti-based alloys such as Ti-Ta-Nb and Ti-Pd which have found widespread acceptance to date are suitable for use in the preparation of the substrate.

This substrate may be formed in the shape of a plate, a perforated plate, a bar, or a net or in any other desired shape. Additionally, this substrate may be coated in advance with a platinum-group metal such as Pt or a valve metal such as Ta or Nb for the purpose of making the electrode more corrosionproof or providing improved adhesiveness with the intermediate layer.

Onto this substrate there is superposed an intermediate layer having Pt dispersed in a mixed oxide consisting of an oxide of Ti and/or Sn, each having a valence of 4, and an oxide of Ta and/or Nb, each having a valence of 5. This invention has been perfected based on a new knowledge that the interposition of this intermediate layer between the substrate and the coat of the electrode enables production of an electrode which excels in conductivity and proves perfectly useful as an amply durable anode particularly in an electrolytic process which proceeds with liberation of oxygen.

The inventors formerly perfected an electrolytic electrode which uses a conducting metal such as Ti as the substrate therefor and coats this substrate with a metal oxide, which electrolytic electrode is characterized by interposing between the substrate and the coat of the electrode an intermediate layer formed of a mixed oxide consisting of an oxide of Ti and/or Sn and an oxide of Ta and/or Nb. This electrolytic electrode is disclosed in commonly assigned pending U.S. patent application Ser. No. 521,764, now U.S. Pat. No. 4,484,999, filed on Aug. 9, 1983. This electrode possesses resistance to passivation and excels in durability. The intermediate layer used in the electrode exhibits good conductivity as an N-type semiconductor. However, since the intermediate layer has a limited carrier concentration, the opportunity existed for further improvement with respect to conductivity.

Owing to the conception of an idea of providing an intermediate layer possessing much higher conductivity than the intermediate layer of the former invention, the present invention has made it possible to produce an electrode which eliminates the drawback suffered by the former invention and offers still higher conductivity and durability.

As the substance to make up the intermediate layer contemplated by this invention, a composite having Pt dispersed in a mixed oxide consisting of an oxide of Ti and/or Sn and an oxide of Ta and/or Nb has been demonstrated to suit the purpose of this invention and manifest an outstanding effect. The substance of the intermediate layer offers excellent resistance to corrosion, exhibits no electrochemical activity, and possesses ample conductivity. The term "mixed oxide" is meant to embrace metal oxides which are nonstoichiometric or have lattice defects. As used in this invention, the term "mixed oxide" embraces those metal oxides represented by $TiO_2$, $SnO_2$, $Ta_2O_5$, etc., for the sake of convenience.

The substance of the intermediate layer, as described above, is substantially a combination of Pt in a metallic form, an oxide of a metal (Ti or Sn) having a valence of 4, and an oxide of a metal (Ta or Nb) having a valence of 5.

Specifically, any of the mixed oxides $TiO_2$—$Ta_2O_5$, $TiO_2$—$Nb_2O_5$, $SnO_2$—$Ta_2O_5$, $SnO_2$—$Nb_2O_5$, $TiO_2$—$SnO_2$—$Ta_2O_5$, $TiO_2$—$SnO_2$—$Nb_2O_5$, $TiO_2$—$Ta_2O_5$—$Nb_2O_5$, $SnO_2$—$Ta_2O_5$—$Nb_2O_5$ and $TiO_2$—$SnO_2$—$Ta_2O_5$—$Nb_2O_5$ can be used advantageously to manifest an ample effect when combined with Pt dispersed therein.

The proportions of the component oxides of the mixed oxide are not specifically defined and may be fixed in a wide range. For protracted retention of the durability and conductivity of the electrode, it is desirable to fix the ratio of the oxide of the tetravalent metal to the oxide of the pentavalent metal in the range of 95:5 to 10:90 by metal mole. The amount of Pt to be dispersed in the mixed oxide desirably falls in the range of 1 to 50 mol% based on the total amount of the substance making up the intermediate layer.

The formation of the intermediate layer in the electrode is advantageously effected by the thermal decomposition method which comprises the steps of applying a mixed solution containing chlorides or other salts of component metals destined to make up the aforementioned intermediate layer to the metal substrate and then heating the coated substrate under a blanket of oxidizing gas at temperatures of about 350° to 600° C. thereby producing a mixed oxide having Pt dispersed therein. Any other method may be adopted instead insofar as the method is capable of forming a homogeneous, compact coat having Pt dispersed in a conducting mixed oxide. By the aforementioned thermal decomposition method, Ti, Sn, Ta, and Nb are readily converted into corresponding oxides while Pt is merely decomposed thermally into metallic platinum and is not converted into an oxide at all. The amount of the substance of the intermediate layer to be applied to the substrate is desired to exceed about $0.1\times10^{-2}$ mol/m$^2$ calculated as metal. If the amount is less than the lower limit mentioned above, the intermediate layer consequently formed will fail to manifest its effect sufficiently.

Subsequently, an electrode active substance possessing electrochemical activity is superposed on the intermediate layer which has been formed on the substrate as described above, to complete an electrode. As the substance to form the coat of the electrode, a metal, a metal oxide, or a mixture thereof which excels in electrochemical properties and in durability can be advantageously used. From among the various substances which fulfill this requirement, a suitable substance may be selected in due consideration of the electrolytic reaction for which the electrode is desired to be used. Particularly suitable for the aforementioned electrolytic process which proceeds with liberation of oxygen are oxides of platinum-group metals or mixed oxides of such oxides with oxides of a valve metal. As typical examples of such oxides, there may be cited Ir oxide, Ir oxide-Ru oxide, Ir oxide-Ti oxide, Ir oxide-Ta oxide, Ru oxide-Ti oxide, Ir oxide-Ru oxide-Ta oxide, and Ru oxide-Ir oxide-Ti oxide. Of course, these substances, similar or dissimilar, may be applied as superposed in two or more layers.

The method for forming the coat of electrode is not specifically defined. Any of the various known methods such as the thermal decomposition method, the electrochemical oxidation method, and the powder sintering method may be suitably adopted. Particularly desirable is the thermal decomposition method which is disclosed in detail in U.S. Pat. Nos. 3,711,385 and 3,632,498.

No definite theory has yet been established to account for the aforementioned outstanding effect of this invention which is brought about when the intermediate layer having Pt dispersed in a mixed oxide of metals having the valencies of 4 and 5 is interposed between the substrate of metal and the active coat of the electrode. One logical explanation may reside in the following postulate:

Since the intermediate layer of a compact mixed oxide of metals incorporating therein dispersed Pt covers the metal surface of the substrate and consequently protects it against oxidation, the substrate is prevented from otherwise possible passivation. The substrate of the intermediate layer itself has Pt dispersed in the mixed oxide of a tetravalent metal and a pentavalent metal. In accordance with the generally recognized principle of valence control, this mixed oxide itself constitutes an N-type semiconductor and possesses high conductivity. Moreover, the Pt incorporated as dispersed in the mixed oxide confers high electron conductivity to the mixed oxide.

Also, since Pt is a substance which offers extremely high resistance to corrosion and has very high potential for the generation of oxygen, it is deficient in eletrochemical activity and generally does not react with the electrode and, thus, functions to heighten the durability of the electrode. If the substrate made of Ti, for example, permits formation of a non-conducting Ti oxide on the surface of the electrode during the manufacture of the electrode or during the use of the electrode in the electrolytic process, the pentavalent metal in the intermediate layer is dispersed to convert the oxide similarly into semiconductors. Thus, the electrode as a whole is allowed to retain its conductivity intact and preclude otherwise possible progress of passivation.

Better still, the substance of the intermediate layer has an ability to adhere intimately to the metal of the substrate such as Ti and to the active coat of the electrode such as of an oxide of a platinum-group metal or an oxide of a valve metal and, therefore, forms a tight union between the substrate and the coat. Thus, the intermediate layer is effective in enhancing the durability of the electrode.

EXAMPLES

The present invention will now be described more specifically below with reference to working examples. This invention is not limited in any way by these working examples:

EXAMPLE 1

A commercially available titanium plate 1.5 mm in thickness was defatted with acetone and then subjected to an etching treatment in an aqueous 20% hydrochloric acid solution at 105° C. to produce a substrate for the electrode. Subsequently, a solution obtained by mixing a 10% hydrochloric acid solution of tantalum titanium chloride containing Ta at a concentration of 10 g/liter (computed as metal, the same applies hereinafter) and titanium chloride containing Ti at a concentration of 10.4 g/liter with a 10% hydrochloric acid solution of chloroplatinic acid containing Pt at a concentration of 10 g/liter was applied to the upper side of the substrate and dried, and the coated substrate was burnt in a muffle furnace kept at 500° C. for 10 minutes. This procedure was repeated twice more. Consequently, on the substrate of Ti, an intermediate layer of a mixed oxide $TiO_2$—$Ta_2O_5$ (Ti80:Ta20 by metal mole ratio) having Pt dispersed therein in a ratio of 1.3 g/m$^2$ was superposed.

Subsequently, a hydrochloric acid solution of iridium chloride containing Ir at a concentration of 50 g/liter was applied to the intermediate layer. The coated layers were burnt in a muffle furnace kept at 500° C. for 10 minutes. This procedure was repeated three more times. Consequently, there was obtained an electrode having an Ir oxide containing Ir at a ratio of 3.0 g/m$^2$ as an electrode active substance.

In an electrolyte of 150 g of sulfuric acid solution per liter kept at 60° C., this electrode was used as an anode with a graphite plate used as a cathode and tested for accelerated electrolysis at a current density of 100 A/dm$^2$. The anode served the electrolysis stably for 360 hours. For the purpose of comparison, an electrode was prepared by faithfully following the procedure described above, except that the incorporation of Pt in the aforementioned intermediate layer was omitted. In the same electrolysis, this electrode was passivated after 150 hours of electrolysis and could not be used any longer.

EXAMPLE 2

Electrodes were prepared by following the procedure of Example 1, except that the substance for the intermediate layer and that for the active coat of electrode were varied as indicated in Table 1. The thus prepared electrodes were subjected to accelerated electrolysis by way of test for performance. The electrolysis was conducted in an aqueous 150 g/liter sulfuric acid solution as the electrolyte under the conditions of 80° C., and 250 A/dm$^2$ of current density, with a platinum plate as the cathode. The results are shown in Table 1.

TABLE 1

| Run No. | Substrate | Intermediate Layer | Electrode Active Substance | Service Life (hrs) |
|---|---|---|---|---|
| 1 | Ti | Pt—$TiO_2$—$Ta_2O_5$ (75:25) | $IrO_2$ | 75 |
| 2 | Ti | Pt—$TiO_2$—$Nb_2O_5$ (80:20) | $IrO_2$ | 80 |
| 3 | Ti | Pt—$TiO_2$—$Ta_2O_5$—$SnO_2$ (70:20:10) | $IrO_2$ | 65 |
| 4 | Ti | Pt—$TiO_2$—$Ta_2O_5$—$Nb_2O_5$ (80:10:10) | $RuO_2$—$IrO_2$ (50:50) | 45 |
| 5 | Ti | Pt—$TiO_2$—$Ta_2O_5$ (40:60) | $RuO_2$—$IrO_2$ (50:50) | 38 |
| 6 | Ti | Pt—$TiO_2$—$Ta_2O_5$—$Nb_2O_5$ (30:40:30) | $RuO_2$—$IrO_2$ (30:70) | 55 |
| 7 (Comparison) | Ti | $TiO_2$—$Ta_2O_5$ (80:20) | $RuO_2$—$IrO_2$ (50:50) | 10 |

Note:
The numerical values given in parentheses represent mole ratios of component metals excluding Pt. The amount of Pt in the intermediate layer was invariably 1.3 g/m$^2$. The amount of the electrode active substance was invariably 3 g/m$^2$ as metal component.

From Table 1, it is noted that the electrodes of this invention incorporating a Pt-containing intermediate layer had decisively longer service life and exhibited higher durability than the electrode (comparison) incorporating an intermediate layer containing no Pt.

EXAMPLE 3

An electrode was prepared by following the procedure of Example 1, except that a mixed oxide of $SnO_2$—$Ta_2O_5$ having Pt dispersed therein (Sn80:Ta20 by metal mole ratio, with Pt dispersed at a ratio of 1.3 $g/m^2$) was used as the intermediate layer and it was similarly tested. The test for electrolysis was carried out in an aqueous 12N NaOH solution under the conditions of 95° C. and 250 $A/dm^2$ of current density, with a platinum plate used as the cathode.

This electrode had a service life of 46 hours. Another electrode was prepared for comparison by repeating the same procedure, except that the inclusion of Pt in the intermediate layer was omitted. This electrode for comparison had a service life of 16 hours. Thus, the electrode of this invention was demonstrated to enjoy very high durability as compared with the other electrode.

We claim:

1. A method for the production of an electrolytic electrode, comprising the steps of preparing a substrate of a conducting metal, depositing a solution containing salts of Ti and/or Sn, Ta and Pt on said substrate to provide a coated substrate, heating the coated substrate with the solution under an oxidizing atmosphere thereby forming an intermediate layer comprising metallic Pt dispersed in a conducting metal mixed oxide of at least one metal selected from the group consisting of Ti and Sn and an oxide of Ta on said substrate, and subsequently coating said intermediate layer with a layer of an electrode active substance.

2. A method according to claim 1, wherein said coating of the intermediate layer with said electrode active substance is carried out by a thermal decomposition method.

3. A method according to claim 1, wherein said intermediate layer is formed by heating the coated substrate under an oxidizing atmosphere at about 350° to 600° C.

4. A method according to claim 1, wherein said substrate is titanium, tantalum, or zirconium or an alloy thereof.

5. A method according to claim 1, wherein said intermediate layer comprises platinum dispersed in a conducting mixed oxide consisting of $TiO_2$ and/or $SnO_2$ and $Ta_2O_5$.

6. A method according to claim 1, wherein said electrode active substance contains a platinum-group metal or an oxide thereof.

7. A method according to claim 1, wherein the amount of said platinum dispersed in said mixed oxide is in the range of 1 to 50 mol% based on the total amount of substance making up the intermediate layer.

8. A method according to claim 1, wherein the oxide of at least one metal selected from the group consisting of titanium and tin and the oxide of tantalum are present in a ratio of about 95:5 to 10:90 by metal mole.

9. A method according to claim 1, wherein said intermediate layer is present in an amount exceeding $0.1\times10^{-2}$ $mol/m^2$ calculated as metal.

10. A method according to claim 1, wherein the substrate of a conducting metal is provided with a coating of a platinum-group metal or a valve metal before the step of forming said intermediate layer.

* * * * *